US011043195B2

(12) United States Patent
Lauermann

(10) Patent No.: US 11,043,195 B2
(45) Date of Patent: Jun. 22, 2021

(54) LIGATURE FOR WOODWIND INSTRUMENTS

(71) Applicant: Walter Lauermann, Unterpleichfeld (DE)

(72) Inventor: Walter Lauermann, Unterpleichfeld (DE)

( * ) Notice: Subject to any disclaimer, the term of this patent is extended or adjusted under 35 U.S.C. 154(b) by 0 days.

(21) Appl. No.: 16/467,378

(22) PCT Filed: Dec. 20, 2017

(86) PCT No.: PCT/DE2017/101092

§ 371 (c)(1),
(2) Date: Sep. 20, 2019

(87) PCT Pub. No.: WO2018/113848

PCT Pub. Date: Jun. 28, 2018

(65) Prior Publication Data

US 2020/0005741 A1 Jan. 2, 2020

(30) Foreign Application Priority Data

Dec. 22, 2016 (DE) ..... 10 2016 125 328.6
Nov. 3, 2017 (DE) ..... 20 2017 106 663.0

(51) Int. Cl.
*G10D 9/02* (2020.01)
*G10D 7/06* (2020.01)

(52) U.S. Cl.
CPC ..... *G10D 9/02* (2013.01); *G10D 7/06* (2013.01)

(58) Field of Classification Search
CPC .. G10D 9/02; G10D 7/06; G10D 9/03; G10D 9/025
See application file for complete search history.

(56) References Cited

U.S. PATENT DOCUMENTS

| | | | | |
|---|---|---|---|---|
| 5,440,962 | A | 8/1995 | Valtchev | |
| 8,940,988 | B1 | 1/2015 | Harrison | |
| 2009/0288544 | A1 | 11/2009 | Wanne | |
| 2012/0085218 | A1 | 4/2012 | Popa Tudor | |
| 2014/0305279 | A1* | 10/2014 | Russell | G10D 9/02 84/380 R |

FOREIGN PATENT DOCUMENTS

| | | | | |
|---|---|---|---|---|
| DE | 384940 | * | 3/1923 | G10D 9/02 |
| DE | 384 940 C | | 11/1923 | |
| JP | S57 141293 U | | 9/1982 | |

* cited by examiner

*Primary Examiner* — Kimberly R Lockett
(74) *Attorney, Agent, or Firm* — Frank H. Foster; Kremblas & Foster

(57) ABSTRACT

Ligature for woodwind instruments, such as a clarinet or saxophone, having a receiving block (4), which is designed to clamp a reed (1) to a mouthpiece (2) of the woodwind instrument, while preventing twisting and/or sliding, by exerting a compressive force (14) on the reed (1), so that an axis of symmetry or longitudinal direction (1*f*) of the reed (1*f*) is aligned with an axis of symmetry or longitudinal direction of a bearing surface of the mouthpiece (2), characterized in that the receiving block (4) is designed to receive the reed (1) in a force-fitting manner and/or to establish a form fit with at least one side surface (1*d*) of the reed (1).

11 Claims, 6 Drawing Sheets

LIGATURE FOR WOODWIND INSTRUMENTS

BACKGROUND OF THE INVENTION

The invention relates to a ligature for woodwind instruments, particularly a clarinet or saxophone, which clamps a reed for playing music on the mouthpiece of the woodwind instrument using a receiving block, while preventing twisting and/or sliding, particularly according to the preamble of claim 1. The invention further relates to the use of the aforementioned ligature. Furthermore, the invention relates to a receiving block according to the preamble of claim 3. It further relates to a ligature for clamping a reed using a spacer device, particularly according to the preamble of claim 10. In addition, the invention relates to a fastening strap for clamping a reed to the mouthpieces of woodwind instruments such as, e.g., a clarinet or saxophone, according to the preamble of claim 16. The invention further relates to a mounting method for a reed having a ligature onto a mouthpiece, particularly according to the preamble of claim 26, as well as use of the ligature (see claim 27).

Clarinet and saxophone, in which the sounds are created by means of a reed are characterized as woodwind instruments. To generate the sound, the player causes the reed clamped to the mouthpiece to vibrate. As a direct consequence, the reed transfers its vibration to the instrument body surrounding it and uses it as a resonance chamber. As the name indicates, most reeds are produced from bamboo cane, reed, or giant reed.

The problem with conventional clamping of a reed is due to the fact that three elements—first the mouthpiece, second the reed, and third the clamping device (this is also known as a ligature)—must be brought into harmony, i.e. into an intended position with respect to one another, as quickly and precisely as possible with only two hands simultaneously. The reed is attached to the mouthpiece for playing music using a ligature. In doing so, the precise placement of the reed on the bearing surface intended therefore on the mouthpiece is decisive. Thus, the front edge of the reed must adjoin the front edge of the mouthpiece somewhat flush, so that the instrument can even produce musical sounds. At the same time, the precise position of the reed on the mouthpiece, the position of the ligature on the reed, and the press-on force the ligature exerts onto the reed has great influence on the individual sound of the musical instrument. Thus, musicians are always interested in obtaining an individual and reproducible sound by means of the reproducible position of the reed.

Where and how the clamping device of the ligature attaches the reed to the mouthpiece is also decisive for the individual sound of the instrument. In addition to size and placement of the contact areas between the clamping device and the mouthpiece, the material of the clamping device is also important. According to the current prior art, the vast majority of clamping devices have a tight, encircling contact with the mouthpiece. The clamping devices often consist of leather, rubber-containing material, or textiles or woven plastic. These materials have a strong frequency-inhibiting or frequency-dampening effect on the mouthpiece. Metallic materials have a natural vibration behavior, which does not correspond, in any case, with the vibration behavior of the mouthpiece. If the clamping device then has a frequency-dampening influence on the mouthpiece, this primarily has an inhibiting effect on the response behavior of the instrument, particularly when producing higher tones. The response behavior is understood to be the delay time with which a desired tone is audible. The production of high tones is essentially more difficult than producing low tones. After music is played, the reed is removed from the mouthpiece and the parts are stored separately. Thus, playing music requires frequent assembly and disassembly processes for the reed and the mouthpiece. Particular for musicians lacking routines, e.g. children, this is a time-consuming procedure prone to mistakes.

In addition, depending on the embodiment of the ligature, the reed is subjected to significant wear, for example, if the tips of adjusting screws leave behind pressure points in the reed. This makes frequent replacement of the reed necessary. In addition, a readjustment of the reed is thereby made more difficult, because the line-shaped or point-shaped pressure contacts between the ligature and the reed return to the pressure points in the reed caused by previous clamping processes. Furthermore, negative effects on the deformation on the sound quality should be assumed. The effort to clamp reeds simply, reproducibility, in a low-wear manner, and to obtain an individual sound, and obviously aesthetic demands for performing musicians have led to ligatures in the most varied of embodiments. Oftentimes, the mouthpiece of the musical instrument has also been modified.

Furthermore, there is no standard for the outer dimensions of the mouthpieces in the area of production of mouthpieces for different woodwind instruments (clarinet, alto saxophone, baritone saxophone, and the like). Thus, in developing a new ligature, it is typically a challenge to find a clamping mechanism which can be used for as many different diameters as possible. Most producers of ligaments divide their products, just as with textiles, into sizes S (Small), M (Medium), L (Large), and XL (Extra Large). When purchasing a new ligature, musicians must have their mouthpiece at hand in order to select the correct size.

If the ligature contains a clamping device, designed as a clamping strap and/or tensioning belt and/or textile loop, and/or woven loop, having an adjusting screw for clamping the reed to the mouthpiece, a ligature which is too large will not provide any stability on the workpiece, while the thread of an adjusting screw which is too small may scratch the mouthpiece in certain circumstances.

EP 0 847 575 B1 discloses a ligature having a ribbed/corrugated fixing plate, which presses the sheet at the ribs against the intended bearing surface on the mouthpiece. By virtue of the fact that this fixing plate is replaceable, various materials can be used for the fixing plate in order to achieve a certain timbre.

US 2014/0305279 A1 describes a ligature with a pressure plate for a reed having one or two axes of rotation, whereby the alignment of the force for pressing of the reed with the pressure plate is adapted to the conical angle of the mouthpiece. In this case, the pressure plate exerts a pressure exclusively on the back of the reed but only when it is already making contact with the bearing surface of the mouthpiece.

DE 20 2015 000 307 U1 discloses a ligature for a woodwind instrument having a bearing element made of lignin sweet grass in order to exert pressure on the reed by means of the clamping force provided by a clamping means. The pressure in this case is exclusively exerted onto the back of the reed.

U.S. Pat. No. 5,000,073 A describes, inter alia, a production method for a ligature, which consists essentially of a punched metal strip, which is equipped with ribs, which extend around the mouthpiece in the circumferential direction. The contact surface to the reed and also to the mouthpiece is intended to be minimized by these ribs.

U.S. Pat. No. 1,525,105 A describes a ligature firmly connected to the mouthpiece. The design of the mouthpiece has a nonmetallic shell and a metal bushing, which is tightly fitted in the diameter of the shell, as the attachment. The reed can be firmly attached to the mouthpiece by means of this metallic inner bushing. However, because it is firmly connected to the mouthpiece, the ligature is not universally useable on other mouthpieces.

US 2004/0177743 A1 is intended to reduce the contact between the ligature and the reed. In doing so, it is provided to use, inter alia, various pressure plates formed with edges and protrusions.

US 2009/10217798 A1 describes a ligature with a flexible, expandable strap material, which has contact with the reed over a large surface in the longitudinal direction, in order to minimize the pressure on the reed and to prevent or dampen the vibrations resulting when forming a tone, which propagate to the mouthpiece and the entire instrument. In particular, this ligature is intended to also reduce the weight.

This ligature from U.S. Pat. No. 1,801,421 A is a frequently used, standard ligature. Due to the many—nonstandardized—mouthpiece sizes (diameter differences), which incessantly come on the market, this embodiment can only be used to a limited extent. Various sizes have been introduced as a remedy, as previously described. However, flexible use is limited.

A new ligature is integrated into a mouthpiece in DE 100 15 108 A1. Metallic components, which are not firmly clamped to one another, tend to "rattle" during resonance formation (sound production) as soon as the natural frequency is achieved. Starting from the front edge of the mouthpiece, the reed is to be pushed against the resistance of a clamping leaf spring. The disadvantage is that the sliding force can only be exerted onto the reed in its most sensitive zone—the front edge of the reed.

US 2012/0085218 A1 discloses a ligature made of ebonite to improve the sound quality, having a tapered hollow cylinder, which is surrounded by clamping rims.

To ensure that a clamping device with an adjusting screw is suitable for differently sized mouthpieces, ligatures with additional adjusting screws, which ensure a minimum distance between the mouthpiece and the adjusting screw, are known from the prior art. The disadvantage here is the assembly procedure for clamping the reed, which is more suited for practiced musicians.

Further known from the prior art is a tension wire or a tension string or a tension cord, with which a reed can be quasi "firmly attached" to a mouthpiece. The principle is comparable to a classic lace-up shoe, which is tensioned with laces/ties. The wire, the string, or the cord exerts even force onto the reed and a large clamping area can be covered. The disadvantage here is that such mounting material is not stable in shape, whereby the mounting of a reed in this case is also not suitable for children and beginners.

The disadvantage with the ligatures from the prior art is likewise that the fixing plates or pressure plates used do not provide any lateral form-fitting or force-fitting guidance for the reed. The ribs also produce pressure points on the side of the reed facing away from the mouthpiece, which makes a subsequent shifting of the reed on the mouthpiece relative to the reed very difficult. In addition, the replacement of the fixing plate or the pressure plate is laborious and prone to errors for unpracticed musicians due to the assembly and disassembly of multiple small parts.

The object of the present invention is to improve the prior art of ligatures for woodwind instruments and to provide a device and a method, wherein differently sized reads are mountable or can be mounted on differently sized mouthpieces simply and reproducibility with a ligature. In order to achieve the object, the ligature in claim 1 and 10, the receiving block in claim 3, the fastening strap in claim 16, the method according to claim 26, and the use of the ligature according to claim 27 are proposed. Optionally, advantageous embodiments of the invention result from the dependent claims as well as from a combination with the respective features of the claims and/or the following description. It should further be noted that the features and measures individually listed in the following description can be combined with one another in any manner practical for musicians and indicate further embodiments of the invention. The description additionally characterizes and specifies the invention, particularly in connection with the figures.

SUMMARY OF THE INVENTION

The invention is a ligature, particularly for woodwind instruments such as a clarinet or saxophone. Said ligature has a receiving block, which affixes a reed to the mouthpiece of the woodwind instrument when music is played by exerting a compressive force, a so-called press-on force, acting on the reed. In doing so, the reed is clamped, while preventing twisting and/or sliding, such that the axis of symmetry or the longitudinal direction of the reed coincides with an axis of symmetry or longitudinal direction of the bearing surface of the mouthpiece intended for the reed and the front edge of the reed adjoins the front edge of the mouthpiece somewhat flush. The receiving block achieves this in that it is suitable or formed to receive the reed in a force-fitting manner and/or to establish a form-fit with at least one side surface of the reed.

The receiving block according to the invention is aligned and attached in the ligature. During clamping of the reed, it is then received in the receiving block and firmly held in position by it. In the next step, the ligature, including the receiving block and the reed, is pushed onto the mouthpiece as a unit. Finally, this unit then only needs to be pushed in the longitudinal axis or axis of symmetry such that the front edge of the reed adjoins with that of the mouthpiece to an extent. Only the connection of the new receiving block according to the invention optionally with a conventional ligature results in a helpful, secure, and quick handling of the ligature, which is also easy to control even by unpracticed musicians or children.

In an advantageous further embodiment, the ligature comprises the suitability for a preassembled arrangement (cf. particularly FIGS. 6*a*, 6*b*, 14) and/or the use as a preassembled arrangement, wherein preassembled arrangement is understood to be a force-fitting and/or form-fitting coupling of the reed and a receiving block holding the reed, before the ligature, with the reed, is pushed onto the mouthpiece. With this preassembled arrangement, the reed is positioned with the receiving block or the ligature in the ligature system and/or coupled to it in a force-fitting and/or form-fitting manner before the coupling with the mouthpiece in its final position relative to the reed. Both the force-fitting and the form-fitting coupling can start from the lateral limiting walls of the receiving block. Either the interior side surfaces of the limiting walls are adapted to the conical curve of the reed and/or the limiting walls have mechanisms for exerting a compressive force on the side surfaces of the reed. The reed can then no longer fall out of the ligature on its own, whereby the musician has both hands available for pushing onto the mouthpiece and the clamping process, for example at the adjusting screw. The option of preassembly has the invaluable advantage for users that they can place, so-to-speak, the reed in position onto the mouthpiece and thus all of the "alignment work" is carried out.

The clamping device for the ligature may be designed as a belt or strap, for example made of leather or plastic, or as a resilient/permanently elastic strap, for example made of metal or plastic. The required clamping force for fixing the reed is provided by an adjusting screw, which connects both ends of the belt or the strap to one another, typically at the side of the mouthpiece facing away from the reed. The clamping force of the adjusting screw exerts a compressive force on the receiving block, which, in turn, presses the reed onto the bearing surface of the mouthpiece. Together with the form-fitting and/or force-fitting engagement of the reed with the receiving block and a locking device between the receiving block and the belt or strap, the reed remains clamped, while preventing twisting and/or sliding, while music is played such that the axis of symmetry or the longitudinal axis of the reed coincides with the axis of symmetry or longitudinal axis of the bearing surface of the mouthpiece, and the front edge of the reed adjoins the front edge of the mouthpiece somewhat flush.

Independent protection of the invention is claimed for the receiving block for the previously described ligature, wherein the receiving block has a mechanism for force-fitting coupling with the reed and/or to form a form-fit with at least one side surface of the reed.

The force-fitting receiving or coupling is provided in an advantageous further embodiment of the invention in that the receiving block has reversibly elastic elements and/or is equipped with permanently elastic deformable material, wherein the material and/or the corresponding element indirectly or directly adapts to the side surfaces of the reed through deformation upon insertion of the reed. Indirect adaptation is understood to be that the contact surfaces between the receiving block and the side surfaces of the reed are formed with rigid material and the permanently elastic material is facing away from the side surfaces of the reed or spaced apart in the limiting walls of the receiving block without having direct contact with the side surfaces of the reed. With suitable elastic properties in at least parts of the receiving block, the interior side surfaces of the receiving block may also extend parallel to the axis of symmetry of the curved inner bearing surface of the receiving block. Upon insertion of the reed into the receiving block, the limiting walls deform according to the side surfaces of the reed, which are tapered toward one another.

In a further advantageous further embodiment, the suitability of the ligature is implemented for a preassembled arrangement with at least one spring bow or other type of elastic bow, for example made of metal or plastic. Said spring bow may be formed with springy elastic, for example rolled, flat material, for example spring steel, brass, or plastic. In a first embodiment, the bows are formed as flexible springs. Comparable with a semi-elliptical leaf spring from motor vehicle construction, the flexible spring is mounted in the center at a support point, in a rotating manner. Upon insertion of the reed into the receiving block, the ends of the flexible springs form contact points with the side surfaces of the reed (cf. FIG. 6*b*). In doing so, the spring sags in that the curvature of the spring decreases. This causes the bow to exert a force-fit, at these contact points, with the side surfaces of the inserted reed.

In an alternative embodiment to this, the spring bow or other type of elastically flexible bow is incorporated into one of the two limiting walls of the receiving block, whereby the respective interior side surface of the corresponding limiting wall is interrupted. The spring bow is suitable for forming a force-fit by acting with a compressive force, particularly with curvature of the bow and simultaneous formation of two contact points, onto the adjoining side surface of a reed to be inserted (cf. FIG. 6*a*). The non-interrupted limiting walls are designed in a complementary shape to the reed in its clamping area and are additionally and/or alternatively available for a form-fit with the reed. With such a preassembled arrangement, a force-fit and a form-fit is simultaneously implementable between the reed and the ligature and thus the mounting of the reed onto the mouthpiece, while preventing slipping and/or sliding, is significantly facilitated.

Preferably, the curved surface of the reed rests against an inner bearing surface along its clamping area in the receiving block, with the bearing surface being formed as a form-fitting curved counterpart to the surface of the reed. This bearing surface extends partially or completely over the length of the curved clamping area of the reed. This also does not result in any pressure points in the reed. Optional limiting walls for the form-fitting guidance of the reed are located at the lateral edges of the curved inner bearing surface of the receiving block. The inner side surfaces of these walls are then formed and arranged such that the side surfaces, which are form-fitting and/or complementary at the tapered side surfaces, rest in the clamping area of the reed or in parts thereof. The form-fitting accommodation is implemented in that the receiving block is designed for partial, form-fitting incorporation of the reed.

The customary reeds on the market are subject to a certain amount of dimensional tolerances and/or production tolerances. Thus, individual dimensions may be too large or too small for an exclusively form-fitting, rigidly formed receiving block. For a form-fitting accommodation however, in order to enable use of any customary reed on the market for any desired position, embodiments with an integrated mechanism for tolerance adaptation are provided, which compensate for the production tolerances. By adding grooves and/or notches at the interior and exterior surface of the receiving block, which extend parallel and simultaneously in pairs axis-symmetrically with respect to the axis of symmetry of the curved inner bearing surface of the receiving block in a line over the entire length of the receiving block, the receiving block obtains a meandering cross-section. The receiving block thereby has its own spring effect, with which the inner side surfaces of the limiting walls function as a leg of a so-called meander spring and rest against the side surfaces of the reed in a form-fitting manner even with dimensional tolerances.

If a spring effect for the receiving block is to be implemented from wood or plastic, elastic spring bows are incorporated into the limiting walls. They preferably extend in pairs axis-symmetrically with respect to the axis of symmetry of the curved inner bearing surface of the receiving block. Upon insertion of the reed into the receiving block, these spring bows curve elastically and preferably in waves while implementing a dot-shaped support, independently of the tolerance deviations of the reed. The spring bows in this case may be between 0.1 mm and more than 1 mm thick, wherein the thickness also depends on the selection of the materials for the bows. Thus, the bows may consist of metal or also of a springy elastic plastic. The deformation of the spring bows as well in this case is completely reversible after removal of the reed.

Depending on the desired timbre, the receiving block may consist of wood, but also of a duroplastic or thermoplastic plastic or of metal. In particular, the receiving block may be produced from the same material as the mouthpiece or as the resonance chamber of the musical instrument. In a preferred embodiment, the receiving block is produced for a clarinet, thus made of grenadilla wood, which is customary for clarinet construction. In order to establish material equivalency with the mouthpiece, the receiving block may be produced from ebonite, a natural rubber. If the inner side surfaces of the limiting walls extend tapered with respect one another, the receiving block must have a permanently elastic deformable material, at least in some areas. A preferred material for this is polyurethane or hard rubber.

In addition to the simple and error-free mounting of the reed to the mouthpiece, also a quick replacement of the receiving block in the ligature is also ensured due to the selection of a suitable fastening fixture so that the interested musician can comfortably try out various embodiments and materials of a receiving block. In particular, a tool-free replacement of the receiving block, that is without the use of screwdrivers or the like, is the goal. Appropriately, at least one recess (for example in the form of a borehole or a pocket) is provided for this, which is locked in place in a clamping device of the ligature with the help of a pin-shaped small part (for example a screw, a rivet, a bolt, or a nail).

Independent protection of the invention is additionally claimed for a ligature with a spacer device according to claim 10. The task of the spacer device is to keep components of the clamping device (such as, for example, a leather belt, a metal strip, or an adjusting screw) from having direct contact with the mouthpiece so that no undesirable components of the ligature hinder the mouthpiece when generating sound and thus developing resonance, and all of the frequency-inhibiting and frequency-dampening influences on the mouthpiece are suppressed or reduced to a minimum. Due to the selection of at least one suitable spacer, particularly suitable material and/or a suitable design, targeted influence can be exerted onto the sound quality of the musical instruments, and particularly on the response behavior of higher notes.

In a preferred embodiment, the spacer or spacers are made of wood or metal. This primarily means that there is no dampening, resonance-inhibiting material such as, for example, a tensioning belt, influencing tone formation. In doing so, the spacer or spacers are preferably made of the same material as the mouthpiece (e.g. ebonite) or the resonance chamber (grenadilla wood) of the musical instrument. An embodiment can thereby be realized, in which a ligature is implemented without the foreign material contact with the workpiece and thus with the resonance chamber of the musical instrument. This leads to the possibility of a so-called pure musical instrument.

In a very simple embodiment according to the invention, these spacers are formed as rod-shaped elements with a length of about 1 cm for the formation of a line-shaped contact area between the spacers and the mouthpiece. These rods are easily inserted, for example, between a tensioning belt and the mouthpiece and prevent contact between the tensioning belt and the mouthpiece. Only the spacers and the reed are thereby in contact with the mouthpiece. For example, a cylinder-shaped or prism-shaped cross-section, which can also change over the length of the spacer, is provided for the spacer. The spacers can be made with solid material or cavities. Alternatively to a line-shaped contact area, a dot-shaped contact area can also be thereby formed between the spacers and the mouthpiece. Combinations of line- and dot-shaped contact areas are also conceivable. Furthermore, the spacers may have additional edges, convex curvatures, or other protrusions or surface ridges.

In an optional further embodiment of the invention, a fixed connection between the rods and the clamping device is also conceivable. Thus, the spacers may also be formed as edges, curves, protrusions, or other surface ridges of a retaining part or multiple retaining parts, which make contact, only as a line-shape or dot-shape, on the side of the mouthpiece opposite the reed. Thus, a retaining part may be formed in the form of an upper part or of a pressure block, as a counterpart, for example, to a receiving block, on the upper side of the mouthpiece. Instead of a receiving block according to the invention, any fixing device can be used for the reed, in addition to the spacer device.

With the use of a receiving block as a component of a ligature according to the invention with a spacer device, this receiving block can primarily be used in any of the previously and subsequently described embodiments of the ligature.

The upper part may optionally have an adjusting screw as a locking means, which supplies the necessary force for the ligature for attachment to the mouthpiece. Furthermore, a contact part, as a part of the upper part, may be located at the top of the adjusting screw. The inner thread, as a counterpart to the outer thread, of the adjusting screw is positioned in a bearing anchor. When the screw is tightened, the contact part presses onto the mouthpiece with formation of a line-shaped contact area. In doing so, a pressure is established, which is transferred to the entire ligature system. However, other obvious methods would also be considered for one of ordinary skill in the art. For an especially quick mounting of the device, a cam lever, for example, would be suitable.

In an optional further embodiment of the invention, rigid anchors can be used instead of the tensioning belt in order to connect the upper part with a receiving block or another fixing device (for example a pressure plate) on the opposite side of the mouthpiece. These anchors can be durably mounted to the bearing anchor of the upper part. The fixing device and the spacer device can thereby be sized as small as desired. The anchors are curved such that the two components are connected to one another without contact, and the force of the locking means is correspondingly transferred to the reed. Particularly with an integral design of the upper part and the spacer, bearing anchors and the contact part are formed, in a preferred embodiment, such that they adapt approximately to the geometry and, in doing so, particularly to the conical curve of the mouthpiece, upon placement of the ligature on the mouthpiece. The connectors are connected to the fixing device and the upper part with the help of the fastening means. For optical reasons as well, especially fastening means as are already used for the individual keys on the musical instrument are suitable here. Simultaneously, the use of material foreign to the musical instrument is thereby desirably reduced according to the invention. The anchors themselves may be produced from aluminum or nickel silver.

A further advantage of the receiving block results from the understanding as to which compressive forces a ligature can exert on the reed and thus onto the press-on force to the mouthpiece. The corresponding force of the ligature extends tangentially to the curve of a tensioning belt or of an anchor. They can be broken down into a vertical and a horizontal force component. While the press-on force is formed from the vertical force, the horizontal force component has no functional effect. Thus, a ligature in which primarily the vertical force component is as strong as possible is desirable. Due to the fixing device and/or the receiving block and particularly its geometric outer dimensions, the form with which the belt wraps around the mouthpiece or the anchor connects to the fixing device can be influenced. In doing so, the larger the outer dimensions of the fixing device, the steeper/more vertical the belt extends or the anchor in the area of the side surfaces of the reed. The vertical force component, which the connector exerts on the reed, is thereby enhanced. In the ideal case, the fixing device and/or the receiving block are wide enough such that the connectors are guided vertically with respect to the center of the side surfaces of the reed, and the connector thus only exerts a vertical force onto the reed. The achievable press-on force of the belt or of the anchor is thereby the maximum.

Independent protection of the invention is claimed for the device indicated in claim 16, namely a fastening strap for clamping a reed onto the mouthpieces of woodwind instruments, such as a clarinet or saxophone, wherein the fastening strap is formed with reversible deformable and/or elastic material. In order to perform or produce the fastening strap, spring-hardened rolled brash sheeting, spring-hardened rolled spring steel, or a suitable plastic, for example, can be used. Any material which is deformed under a certain tension is suitable in order to subsequently return elastically to the starting state without remaining deformation. Furthermore, the fastening strap is characterized by a clamp, which is formed as a preferably longitudinally formed elastic strip, sheet metal strip, or wire piece or has such for bending around the mouthpiece. This strip can be a spring-hardened rolled brass sheet and/or spring steel strip and/or a plastic. Such strips are typically used for flat springs. Because the fastening strap is component visible on the mouthpiece from the outside, it can be silver-plated for optical reasons. Furthermore, the fastening strap has a strip, which has a first end section, a middle end section and a second end section, wherein the sheet metal strip is bendable and/or bent for surrounding and/or encompassing a mouthpiece and the two ends or at least two end sections each have a mechanism for direct coupling with one another. The sheet metal strip forms an approximately circular surface, which is essentially aligned vertically with respect to a longitudinal axis of the mouthpiece, when encompassing the mouthpiece. The coupling is typically simultaneously a locking mechanism, whereby the sheet-metal retains the form it assumed when encompassing the mouthpiece. In the case of an indirect coupling, an additional intermediate part or an adapter can be used between the end sections of the clamp.

In a preferred further embodiment of the invention, the clamp has a mechanism for coupling to its first end section of the strip, which is formed as a slotted hole and/or groove and/or track and/or recess and/or a notch. The slotted hole can be punched or milled for example.

Optionally, the mechanism for coupling to the second end section of the strip is additionally formed as an engagement element or complementary counter-notch for coupling with the slotted hole and/or the groove and/or the track and/or the recess and/or the notch. The locking effect which keeps the end sections of the strip together is achieved by means of the engagement element, for example in the slotted hole.

In a preferred embodiment, the mechanism for coupling and/or the engagement element is formed with the strip as a single part. Thus, the bow, having the strip, the slotted hole, and the engagement element are punched, for example, as a part from sheet material.

In a further optional embodiment of the invention, the fastening strap comprises a slotted hole and/or groove and/or track and/or recess and/or notch formed as a guide. The engagement element remains movable or adjustable along this guide for/with locking and/or coupling. The diameter which can encompass the fastening strap is aligned in this guide or in this slotted hole according to the relative position of the engagement element. If the engagement element is moved along the guide to the middle part of the strip, the diameter encompassed by the strip or by the clamp becomes smaller. If a suitable mouthpiece is inserted into the fastening strap, the clamping process can be introduced in that a reed coupled to the clamp is pressed onto the mouthpiece, for example by means of a receiving block according to the invention. With this mechanism, a reed can also be clamped and/or mounted onto differently sized mouthpieces. Thus, a comparatively large clamping area can be covered.

In order to adapt to the conical curve of the mouthpieces, the fastening strap has a clamp in a preferred embodiment of the invention, wherein the first and/or the second end section is formed as an elongated leg. When considered in the unrolled, flatly placed state, these legs are aligned against a horizontal axis or longitudinal axis of the strip or its middle part at an angle of 10° or of 5-40° for example, wherein the angle may vary depending on the conicity of the mouthpiece. This approximately horizontal axis or longitudinal axis of the strip extends essentially parallel to the base and approximately vertical to the longitudinal axis of the mouthpiece. In an optional further embodiment of the invention, the middle part of the fastening strap has suspension means for mounting a fixing device, for example a receiving block or another pressure plate, for a reed on the mouthpiece. These suspension means may be formed, for example, as holes punched in a sheet metal strip. The fixing device can be mounted at these holes by means of suitable fastening means, for example screws or locking pins.

In a preferred embodiment of the invention, the fastening strap is equipped with an adjusting screw or another manually operable adjusting element for shifting or adjusting the engagement element during the clamping process of the reed to the mouthpiece along the guide, which is formed by the slotted hole and/or groove and/or track and/or recess and/or notch. Through actuation of the adjusting screw, the clamping process or the clamping movement of the fastening strap is introduced on or opposite an intended musical instrument. The diameter encompassed by the strip and/or the fastening strap thereby becomes broader or narrower until finally the desired clamping force for the reed is achieved.

In an optional further embodiment of the invention, the adjusting screw of the fastening strap has a thread, which has a first thread section and a second thread section. In doing so, the first and the second thread section have opposite directional rotations with respect to each other. The first section, adjacent the handhold of the adjusting screw, may have, for example, a right-hand thread. In this case, the second section, which is arranged further away from the handhold of the adjusting screw, has a left-hand thread. The handhold of the adjusting screw may also be arranged in the middle between the two sections and formed as an adjusting wheel. Furthermore, the coupling of the clamp to the adjusting screw is implemented in that a nut with an inner thread is mounted on a first end section or in the area of the first end section of the clamp. Alternatively or in addition to this, coupling of the clamp to the adjusting screw is implemented in that a nut with an inner thread is mounted on the second end section or in the area of the second end section of the clamp. The nuts are connected to the clamp by means of welding, bonding, riveting, and/or pressing. In an advantageous embodiment of the fastening strap, the nuts of the first end section are formed in a complementary manner to the second thread section of the adjusting screw and/or the nuts of the second end section are formed in a complementary manner to the first thread section of the adjusting screw, i.e.

they are intermeshed. For example, if the first thread section has a right-hand thread, the nut of the second end section of the clamp is formed in a complementary manner and for an intermeshed engagement with a right-hand thread.

An optional further embodiment of the fastening strap according to the invention is formed such that the clamping process for clamping a reed to the mouthpiece can be implemented upon actuation of the adjusting screw in a first direction of rotation and, in doing so, the distance between the two nuts enlarges due to the opposite direction of rotation of the thread sections. During the removal process of the fastening strap from the mouthpiece, the adjusting screw is rotated with the other second direction of rotation, opposite the first direction of rotation, wherein the distance between the two nuts reduces. The movement of the nuts extends approximately symmetrically to a plane of symmetry of the mouthpiece, which results in a symmetrical application of force.

In an alternative further embodiment of the invention, a previously described upper part and/or pressure block and/or previously described bearing anchor and/or previously described contact part is provided, which is pressable or can be pressed against the surface of the mouthpiece during the clamping process. On one hand, this prevents the mouthpiece from being scratched by the thread of the adjusting screw and/or the sheet metal. On the other hand, the material for the contact surface between the fastening strap and mouthpiece can thereby be selected as desired.

In yet another embodiment of the fastening strap, it has a receiving block with at least two elastic spring bows, for example made of metal or plastic. In doing so, either a spring bow is incorporated into one of the two limiting walls of the receiving block or a spring bow is formed as a flexible spring and preferably positioned upstream of the limiting wall so as to rotate. This results in a symmetrical and thus especially stable force-fit due to the action with a compressive force, on both sides, onto the side surfaces of the reed with preferably four contact points between the spring bows and the reed, particularly with the preassembled arrangement, between the receiving block and the reed. The form-fit can also be implemented with this embodiment additionally, on one hand, via the conicity of the limiting walls of the receiving block and, on the other hand, via the tolerance-compensating leaf springs in the limiting walls or upstream of the limiting walls.

In the preferred embodiment, the ligature for each mouthpiece is suitable and no modifications must be carried out on the mouthpiece. In further embodiments according to the invention, individual features of the ligature according to the invention may be durably integrated into the mouthpiece. The presented ligature in this case is not limited to instruments such as a clarinet or saxophone but is rather possible for a plurality of woodwind instruments with reeds due to the obvious technical adaptations. Because of the fact that the mouthpiece does not have to be modified, the retrofitting of existing instruments/mouthpieces is simplified.

Independent protection of the invention is further claimed for a method for mounting a reed onto a mouthpiece for woodwind instruments such as a clarinet or saxophone. The method is broken down into the following steps:

Insertion and/or sliding in of a reed, with the bottom free to the outside, optionally at an existing marking, into the receiving block or into the ligature at a predetermined end position relative to the receiving block while forming a preassembled arrangement, until either the inner side surfaces of the limiting walls surround the side surfaces of the reed in a form-fitting manner and/or a predetermined force-fitting coupling directed to the side surfaces of the reed is formed between the receiving block or the ligature and the reed.

Pushing this preassembled arrangement onto the mouthpiece with flush alignment of a reed front edge with a front edge of the mouthpiece. Due to the form-fit and/or particularly the force-fit, which targets a force onto the side surfaces of the reed, the reed remains in the intended position relative to the receiving block and/or to the other ligature. The reed can no longer easily fall out of the ligature and the musician is not forced to hold the reed with one hand in the intended position in the ligature and/or on the mouthpiece.

Actuation of a clamp, for example a fastening strap, of a clamping screw or of a cam lever to clamp or press the reed bottom onto the bearing surface intended for this, in the clamping area of the reed. The ligature automatically takes on the centered alignment of the reed on the axis of symmetry or longitudinal axis of the bearing surface of the mouthpiece during clamping. This additionally facilitates the clamping of the reed.

BRIEF DESCRIPTION OF THE SEVERAL VIEWS OF THE DRAWINGS

Further details, features, feature combinations, effects, and advantages of the invention result from the following description of the invention and the drawings. The following is shown.

DETAILED DESCRIPTION OF THE INVENTION

Figure 1:
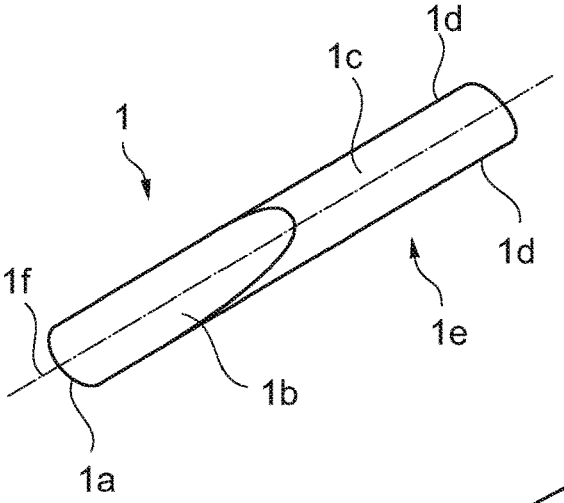
Fig. 1 PRIOR ART
FIG. 1 shows a perspective representation of a customary reed on the market.

FIG. 1 shows a common, usually symmetrical reed 1 with the axis of symmetry or longitudinal axis 1*f* for reed and/or woodwind instruments. The front edge 1*a* is the vibrating edge of the vibration area 1*b*. In a clamping area 1*c*, which is thickened as compared to the vibration area 1*b*, the reed is clamped in a ligature, wherein its clamping devices according to the prior art exert a more or less large-surfaced press-on force onto the surface, which is curved in the transverse direction of the reed, of the clamping area 1*c*. Because the reed must vibrate in the vibration area 1*b* to generate sound, it only has a very small thickness, which leads to formation of the two lateral limiting surfaces 1*d*. In the clamping area 1*c*, the lateral limiting surfaces 1*d* extend in a taper with respect to each other such that the reed 1 becomes increasingly narrower toward the rear. Not shown in this figure is the completely flatly formed bottom 1*e* (cf. FIGS. 6*a*, 6*b*) of the reed, which forms the contact to the bearing surface of the mouthpiece 2 after assembly (cf. FIG. 2).

Figure 2:
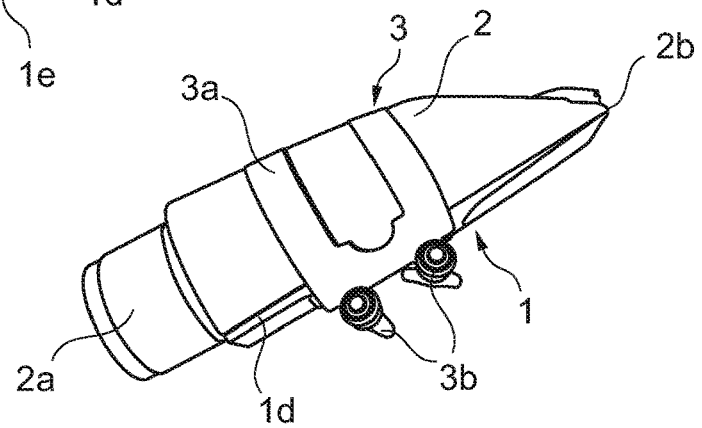
Fig. 2 PRIOR ART
FIG. 2 shows a perspective view of the assembly of a mouthpiece, of a customary ligature on the market, and of a reed, as known in the prior art.

FIG. 2 shows a standard design of an assembled mouthpiece 2 for playing music, as it is used with a large majority of woodwind instruments with a reed 1. The mouthpiece 2 has a connecting part 2*a* to the sound-producing chamber of the musical instrument, as well as a front edge 2*b*, into which the air is blown by the musician. In doing so, the front edge 2*b* is necessarily somewhat flush with the front edge of the reed 1*a*. The ligature 3 according to the prior art is mounted in the clamping area 1*c* of the reed. The bottom 1*e* of the reed rests against a usually axis-symmetrical bearing surface of the mouthpiece 2. The ligature 3 has a sheet 3*a*, which comprises the mouthpiece 2 together with the reed 1. The clamping force of the ligature 3 and thus the press-on force onto the reed 1 is exerted by two adjusting screws 3*b*. A special guide for the reed 1 for torsion-resistant and/or slide-resistant assembly, particularly also for a preassembled arrangement 7, 19 (cf. FIGS. 6*a*, 6*b*, 14) is not provided.

Figure 3:
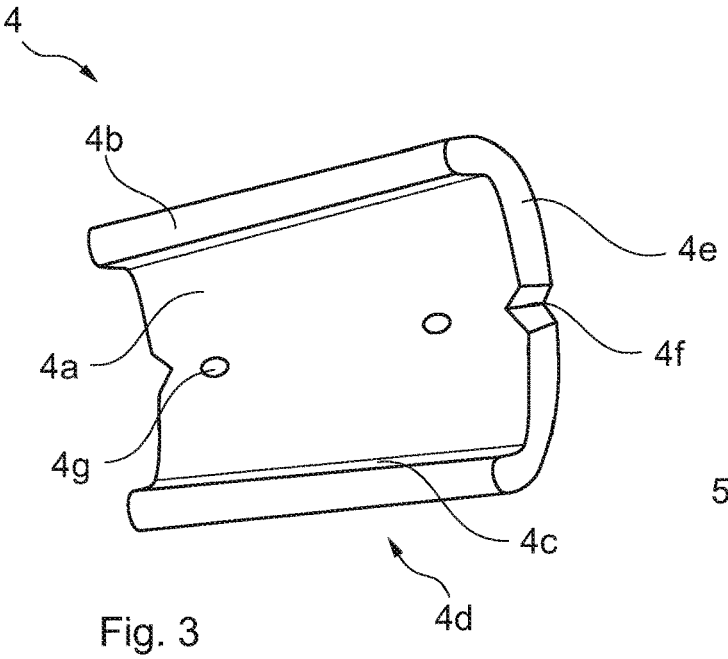
FIG. 3 shows a perspective view of a receiving block made of wood, which is adapted to the reed in a form-fitting manner.

According to FIG. 3, the reed 1 is first inserted into a preferably axis-symmetrically formed receiving block 4, which may be made of wood, as indicated in FIG. 3. The exclusively form-fitting ligature for the reed 1 in this exemplary embodiment is achieved in that, on one hand, the inner bearing surface 4*a* of the receiving block 4 is formed in a complementary manner with respect to the curved clamping area 1*c* of the reed 1. On the other hand, the limiting walls 4*b* and the inner side surfaces 4*c* formed on the inner sides of the walls are adapted to the conical curve of the lateral limiting surfaces 1*d* of the reed 1. The formation of the surfaces (4*a*, 4*c*) means that no point-by-point forces must act on the reed 1, which reduces the wear of the reed 1. The outer surface 4*d* of the receiving block 4 faced away from the reed may likewise be curved suitably. To facilitate assembly, a marking 4*f* formed, for example, with a notch or other recess is located at the front edge 4*e* of the receiving block 4. This marking 4*f* shows the musician that, at this point, the reed 1 must be inserted into the receiving block 4 with the front edge 1*a* ahead. In order to lock the receiving block 4 at the remaining components of the ligature 5 (cf. FIG. 4), there are two through-holes 4*g* arranged preferably symmetrically to a longitudinal and/or transverse axis in the inner bearing surface 4*a* of the receiving block 4.

Figure 4:
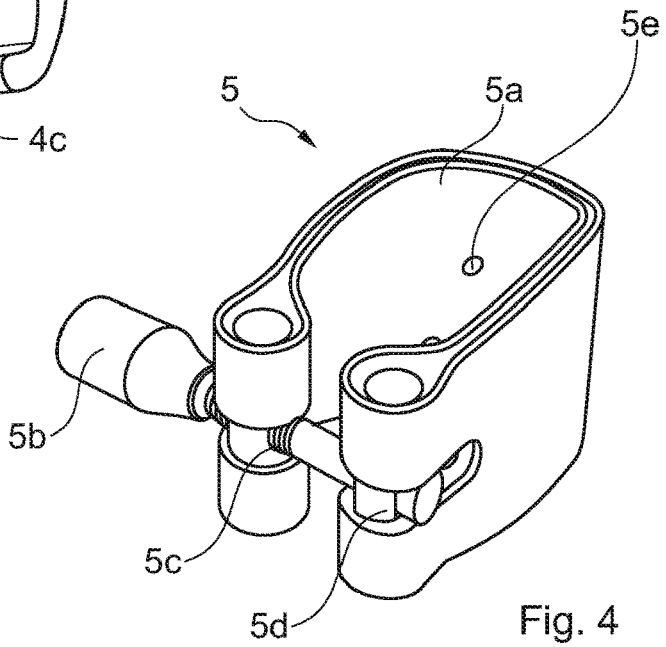
FIG. 4 shows a perspective view of a clamping device with belts and an adjusting screw to encompass the mouthpiece.

FIG. 4 shows the ligature and/or clamping devise formed according to the invention for the receiving block 5, wherein the receiving block 4 (cf. FIG. 3) can be combined with the most varied of ligatures 5 from the prior art. In a preferred embodiment, the clamping device 5 consists of a strap/belt 5*a*, for example made of leather or plastic, the ends of which are clamped together by means of an adjusting screw 5*b* with thread 5*c* and two guides 5*d* on the side of the mouthpiece 2 facing away from the receiving block 4 (cf. FIG. 8). According to FIG. 4, the strap/belt has two receiving holes 5*e*, which are placed congruently with the boreholes 4*g* of the receiving block 4 (cf. FIG. 3).

Figure 5:
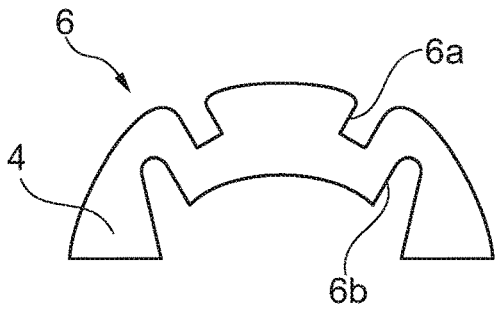
FIG. 5 shows a sectional view of a receiving block, equipped with a meander spring.

FIG. 5 shows an alternative embodiment of the receiving block 4 with a meander spring 6, through which the reed 1 (cf. FIG. 1) can be pushed into the receiving block to different distances and, in doing so, still remain surrounded, in a form-fitting manner, by means of the limiting walls 4*b* of the receiving block 4 (cf. FIG. 3). This form of the spring is achieved in that, on the outer surface 4*d* of the receiving block, at least two grooves, notches, or other recesses 6*a* are milled over their entire length or also a part thereof in pairs, symmetrical and parallel to the axis of symmetry of the receiving block. To enhance the spring effect, a similar formation is undertaken at the inner side of the receiving block 4, for example at the cutting edge between the inner side surfaces 4*c* and the inner bearing surface 4*a* (cf. FIG. 3). An adaptation of the receiving block 4 to the dimensional deviations during the production of reeds 1 is possible by means of this embodiment of the invention.

Figure 6A:
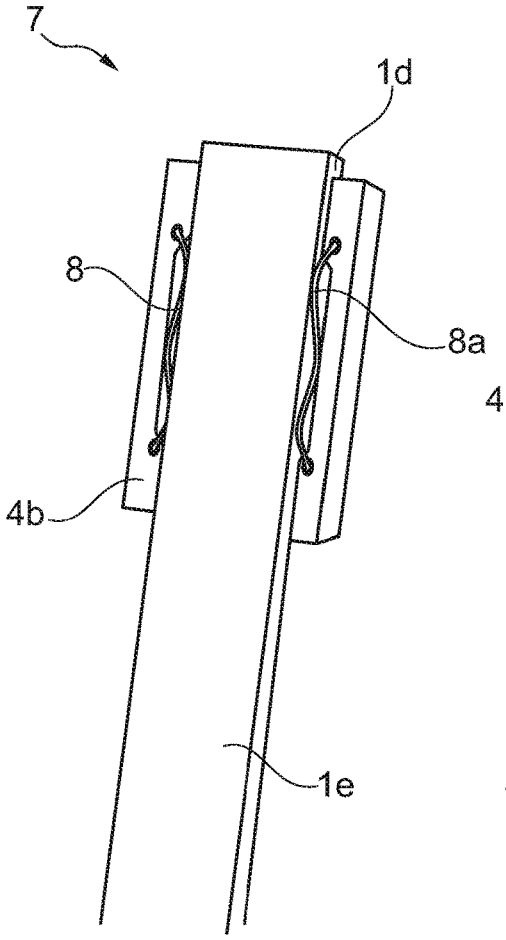
FIG. 6*a* shows a perspective view of a preassembled arrangement with a receiving block having laterally incorporated spring bows for forming a force-fit onto the side surfaces of the reed.

FIG. 6*a* shows an embodiment of a preassembled arrangement 7 for forming a form-fit and/or simultaneously a force-fitting coupling with the side surfaces 1*d* of the reed 1. Depicted is a receiving block 4 with the reed 1 inserted, wherein its flat bottom 1*e* is facing the observer. Two elastic spring bows 8, which are bent or curved one or more times, are affixed, with mechanical clamping at their ends, in the limiting walls 4*b* of the receiving block. Upon the insertion of a reed 1, the spring bows 8 bend in the shape of waves such that contact points 8*a* form between the spring bow 8 and the side surfaces 1*d* of the reed. Simultaneously, the inner side surfaces 4*c*, which are not visible here, rest against the side surfaces 1*d* of the reed in a form-fitting manner in the end areas of the receiving block 4. If a reed 1 is somewhat smaller due to production tolerances, it can still be affixed at the desired point in the receiving block 4 due to the force-fit of the spring bows 8.

Figure 6B:
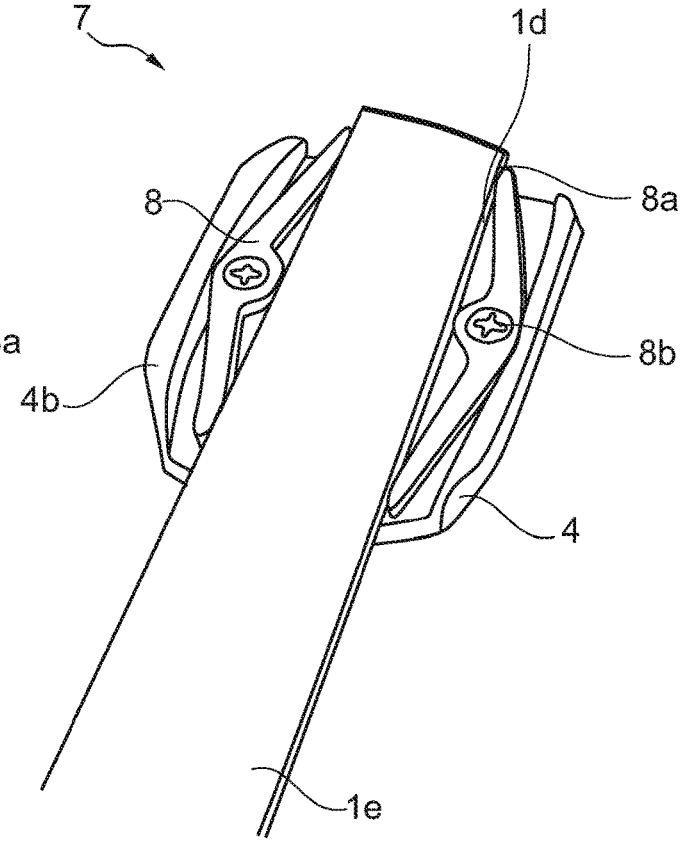
FIG. 6*b* shows a perspective view of a preassembled arrangement with a receiving block having laterally adjoining spring bows for forming a force-fit onto the side surfaces of the reed.

FIG. 6*b* shows an alternative embodiment to this of a preassembled arrangement 7 with a receiving block 4 for forming at least one force-fitting coupling with the side surfaces 1*d* of the reed 1. Depicted is likewise a receiving block 4 with the reed 1 inserted, wherein its flat bottom 1*e* is facing the observer. The limiting walls 4*b* themselves do not form any form-fit with the reed. Instead, two elastic bows 8, preferably mounted in the middle and/or so as to rotate, act upon the side surfaces 1*d* of the reed 1 while forming a mechanical compressive force at the preferably terminal contact points 8*a*. In this depiction, the elastic bows 8 are upstream of the limiting walls 4*b* with respect to the plane of symmetry and/or middle plane of the receiving block 4. Upon the insertion of a reed 1, the spring bows 8 bend with a decrease in the curvature. The reed 1 can then be inserted into the receiving block 4 until the side surfaces 1*d* of the reed, which are tapered with respect to one another, impact the central bearing points 9*b*, which are simultaneously formed as axes of rotation of the spring bows 8. In this end position, a form-fit is additionally achieved in addition to the force-fit.

Figure 7:
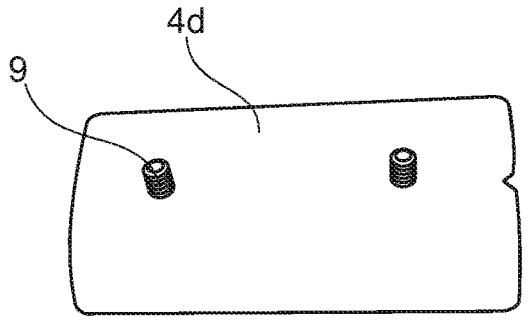
FIG. 7 shows a perspective view of a receiving block with locking screws for locking at a tensioning belt.

FIG. 7 shows the receiving block from FIG. 3 in a view of the outer sheath 4*d*, through the locking boreholes 4*g* of which two locking pins 9 are guided. The locking pins 9 are intended to connect or make connectable the receiving block 4 with a clamping device 5 in the holes 5*e* intended for this (see FIG. 4).

Figure 8:
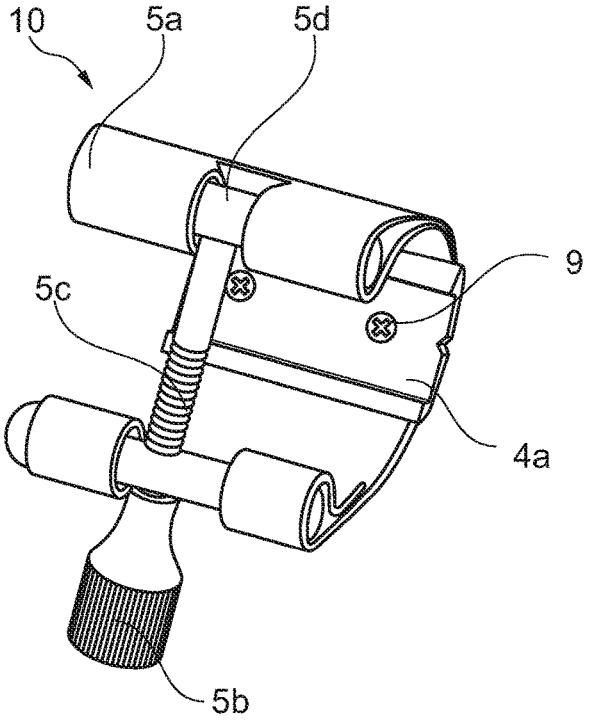
FIG. 8 shows a perspective view of a preassembled arrangement made of belts, adjusting screw, and receiving block with locking screws.

FIG. 8 shows an arrangement of the clamping device 5 together with the receiving block 4, still before the insertion of the reed 1. The strap/belt 5*a* likewise has two receiving holes 5*e* (see FIG. 3), into which the locking pins 9 can be inserted. The boreholes in the strap/belt 5*a* have no thread. This makes a simple and tool-free replacement of the receiving block 4 possible in order to try out the receiving block with various materials for example.

Figure 9:
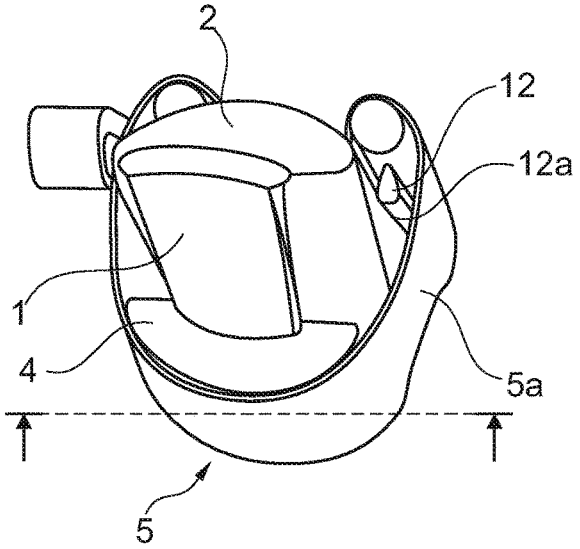
FIG. 9 shows a perspective view of an assembly made of a ligature with spacers.

FIG. 9 shows an assembly according to the invention, based on the arrangement 10, of the reed 1 and of the mouthpiece 2 together with the spacers 12. In this embodiment, the spacers 12 fulfill the function of keeping any contact between the clamping device 5 and the mouthpiece 2 as small as possible and to suppress it completely in the ideal case. For this function, the spacers 12 are inserted between the strap/belt 5*a* and the mouthpiece 2 on both sides of the mouthpiece 2 (cannot be seen on the left). The spacers 12 themselves are formed such that the contact area 12*a* between them and the mouthpiece 2 is formed in the shape of dots and/or a line. Damping effects of the tensioning belt 5*a* on the sound quality and the response behavior are thereby suppressed. The spacers 12 can be made from any material, particularly from the same material as the mouthpiece 2 and/or the sound-producing chamber of the musical instrument. In order to keep the dimensions of the spacers 12 as small as possible, the receiving block 4 can be enlarged accordingly so that the side areas of the tensioning belt 5*a* are routed as far away from the mouthpiece 2 as possible.

Figure 10:
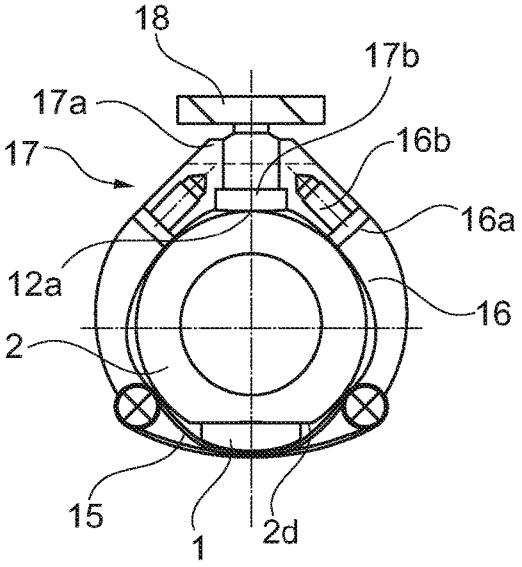
FIG. 10 is a sectional view of an assembly with a spacer device having a fixing device on the reed after assembly.
Figure 11:
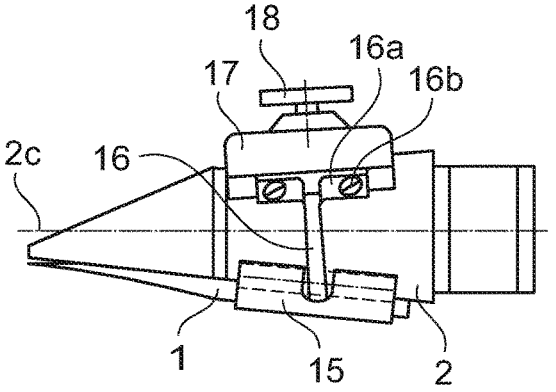
FIG. 11 shows a side view of the embodiment according to FIG. 10.

FIG. 10 shows a sectional view of a ligature, transverse to the longitudinal axis 2*c* in FIG. 11, which has a spacer device. With this spacer device, the contact points, lines, and/or surfaces 12*a* are formed as edges or protrusions of an upper part 17. The upper part 17 is connected to a simple fixing device 15, which affixes the reed 1, on the other side of the mouthpiece 2 via two rigid anchors 16. Any device known to musical experts, particularly a pressure plate, is suitable as the fixing device 15. A contact with the mouthpiece 2 is only established on the reed 1 itself and on the contact area 12*a*. To do this, the anchors 16 rest against the upper part 17, in a form-fitting manner, via a flat contact 16*a*. The reed 1 can no longer be twisted or slid after mounting by means of fastening means 16*b*, as they can be found also, for example, on the reed valves of the musical instrument. The clamping force is provided by the upper part 17. It consists of a bearing anchor 17*a*, to which the anchors 16 are connected. The clamping force itself is generated by a contact part 17*b*, which is connected to a knurled screw 18, as an adjusting screw, by means of a thread. The inner thread, which is intermeshed with the adjusting screw, is located in the bearing anchor 17*a*. If the knurled screw 18 is tightened, the contact part 17*b* moves onto the mouthpiece 2 and forms a line-shaped contact area 12*a* to the mouthpiece 2.

FIG. 11 shows a side view of the embodiment from FIG. 10. Shown here is the tapered middle part of the mouthpiece 2, mounted around the ligature with a spacer device, in order to connect the reed 1 to the mouthpiece 2 in the reed's clamping area 1*c*. For the most form-fitting hold possible of the ligature on the mouthpiece 2, the fixing device 15 and the upper part 17 can be tilted with respect to each other, transverse to a longitudinal axis 2*c* of the mouthpiece.

Figure 12:
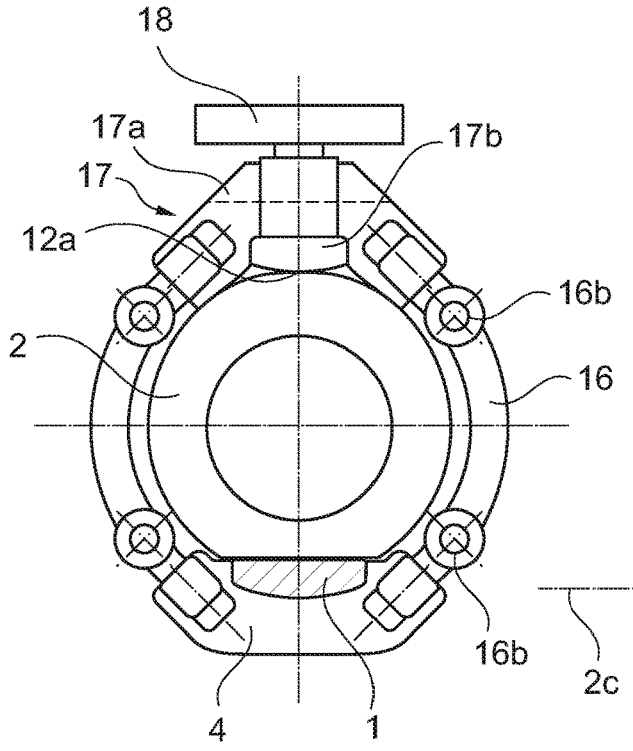
FIG. 12 is a sectional view of an arrangement with a spacer device having a receiving block on the reed after assembly.
Figure 13:
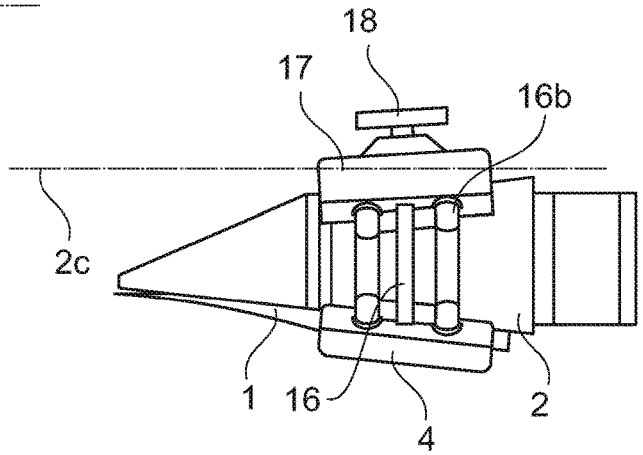
FIG. 13 shows a side view of the embodiment according to FIG. 12.

FIG. 12 shows a sectional view of an inventive embodiment transverse to the longitudinal axis 2*c* in FIG. 13, with two differences with respect to the embodiment from FIG. 10. The fixing device 15 has been replaced by a receiving block 4 according to the invention with all of the resulting, previously described advantages. Furthermore, the anchors 16 on the connection to the bearing anchors 17*a* do not form any flat bearing surface 16*a*. The lack of the flat contact surface 16*a* can be clearly understood in FIG. 13.

Figure 14:
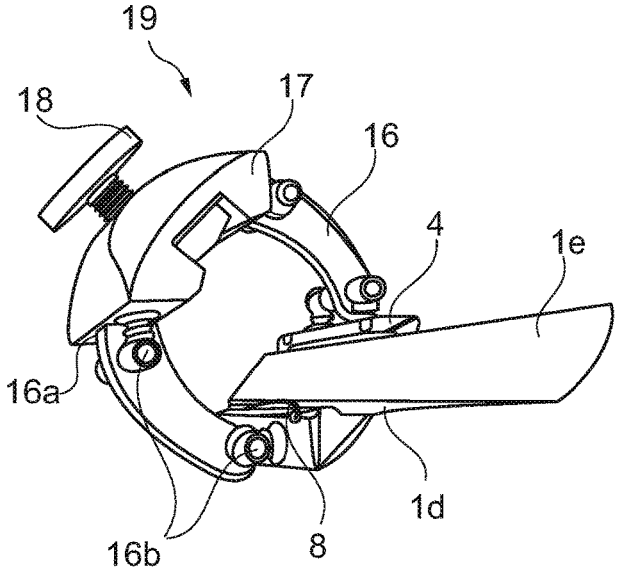
FIG. 14 shows a perspective view of a preassembled arrangement comprising an upper part, receiving block, anchor, and reed.

FIG. 14 shows the preassembled arrangement 19 of a ligature according to the invention with a spacer device (16, 17, 18) and receiving block 4 (cf. preassembled arrangement 7 with spring bows 8, FIG. 6*a*). According to the method in accordance with the invention, the reed 1 is inserted to the rear into the desired position in the receiving block 4 such that the spring bows 8 make contact with the side surfaces 1*d* of the reed. The desired position is understood to be the position of the reed 1 relative to the receiving block 4. Due to the force-fit, which is simultaneously formed by the spring bows 8, the reed 1 can no longer change this position; in particular, it cannot fall out of the receiving block 4.

Figure 15:
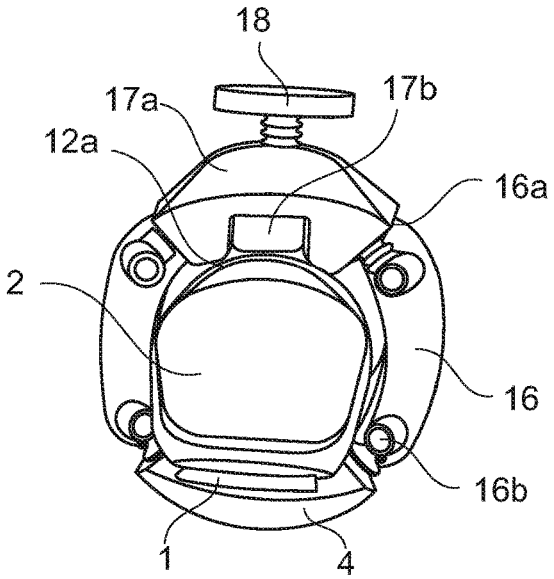
FIG. 15 shows a perspective front view of the assembly.
Figure 16:
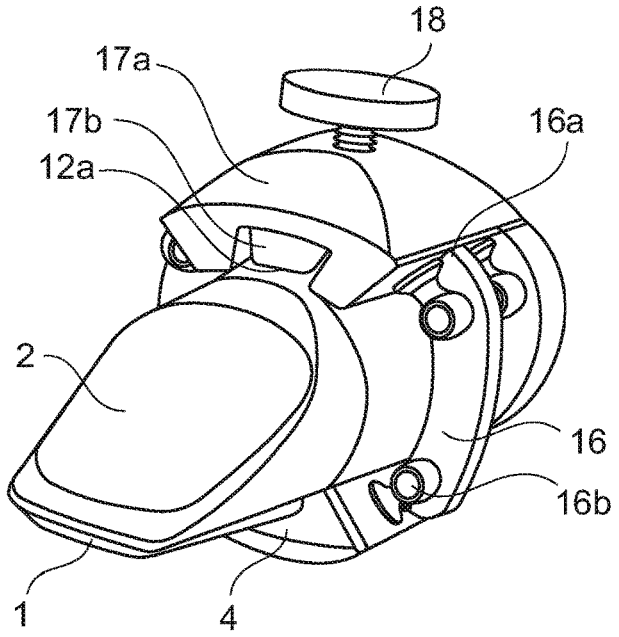
FIG. 16 shows a perspective side view of the assembly.

FIG. 15 and FIG. 16 show perspective views of the assembly with the mouthpiece 2, based on the preassembled arrangement 19 according to FIG. 14. In this design, the contact between the preassembled arrangement 19 on the mouthpiece 2 is on the reed 1 itself and the contact surface 12*a* is limited on the contact part 17*b*. With the tightening of the knurled screw 18, the reed 1 is also affixed, ready to play music, in a twist-resistant and slide-resistant manner.

Figure 17:
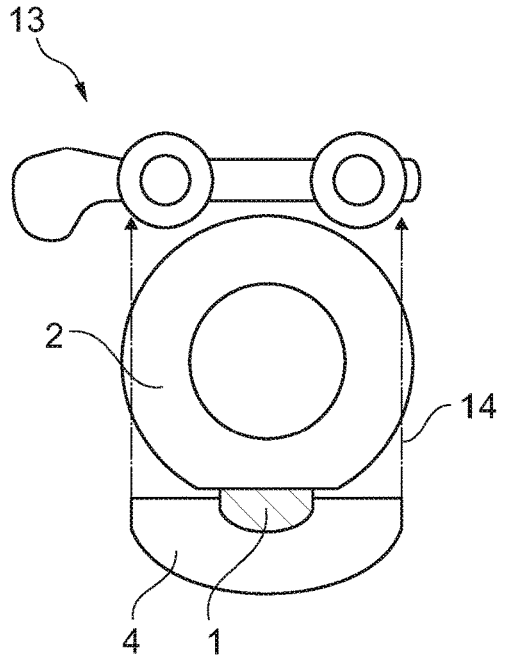
FIG. 17 shows a sectional view of the assembly with an enlarged receiving block with force directions indicated which act on the reed.

FIG. 17 shows a sectional view of the assembly, undertaken along the dashed line through the mouthpiece 2, indicated in FIG. 9, wherein the spacers 12 and the tensioning belt 5*a* are hidden to simplify the representation. The influence of the receiving block 4 on the press-on force 14, which presses the reed 1 onto the mouthpiece 2, is shown here. If the force which the tensioning belt 5*a* exerts tangentially to its curve is broken down into a vertical and a horizontal component, only the vertical component is responsible for the press-on force of the reed 1 onto the mouthpiece 2. The more vertically the tensioning belt 5*a* is placed passed the reed 1, the larger the vertical component of the clamping force of the belt 5*a*. In the present embodiment, the receiving block 4 is designed so wide that the tensioning belt 5*a* can be placed completely vertically passed the mouthpiece 2. Thus, the clamping force 14 of the belt 5*a* is exclusively used for the twist-resistant and/or slide-resistant pressing of the reed 1 at the corresponding point, which reduces the risk of slipping when playing music. Through suitable dimensioning, also the spacer device, particularly the upper part 17 and anchor 16, can cause the press-on force 14 to be formed advantageously.

Figure 18:
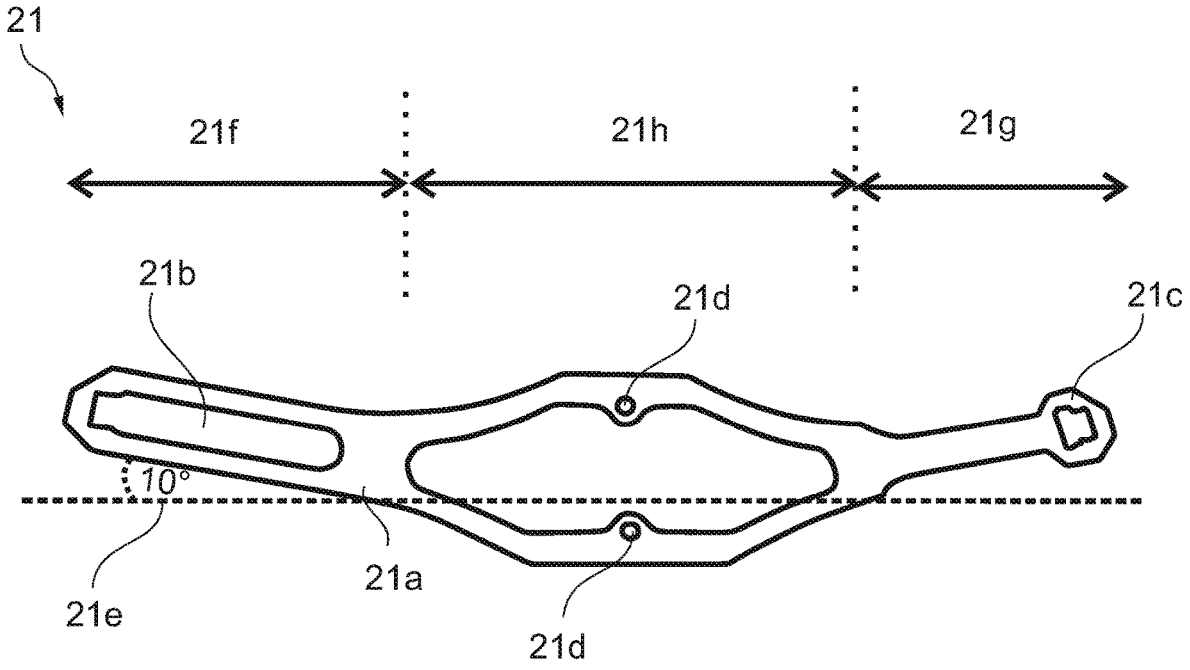
FIG. 18 shows a top view of the unrolled strip of a clamp.

FIG. 18 shows a clamp 21 for a fastening strap 20 (see FIG. 20), which is formed as one piece with an elongated strip 21*a* according to the exemplary embodiment. The clamp 21 and/or the strip 21*a* is preferably formed with spring-hardened rolled brass sheeting, elastically bendable plastic, or comparably suitable materials and is shown in the flatly placed state according to FIG. 18. Its elongated basic shape can be divided into three sections: A middle part 21*h* and two end sections 21*f*, 21*g*, which adjoin one another at one of the two opposites ends of the per se elongated middle part 21*h*. The latter is broadened as compared to the two in areas 21*f*, 21*g* and suitable for mounting fixing devices (general 15, cf. FIG. 10 and/or receiving block 4, cf. FIG. 13) for a reed 1 on the mouthpiece 2. The first end section 21*f* (to the left in FIG. 18) is equipped with a recess, which forms a slotted hole 21*b* to engage an engagement element 21*c*. The latter is designed in the form of a widening as compared to the longitudinal extension of the strip 21*a* on the available end of the second section 21*g*. In its middle section 21*h*, an elongated middle recess or punch-out is optionally formed, which particularly serves to reduce the weight. The opposite elongated edges, which terminate the middle recess on both sides, are equipped with suspension means 21*d*, implemented as punched or drilled attachment holes according to the exemplary embodiment, which are preferably arranged in the middle with respect to the longitudinal extension of the strip 21*a*. With respect to a longitudinal axis 21*e* of the middle part 21*h*, the two end sections 21*f*, 21*g* extend in tilted alignment, wherein an acute angle of, for example, 5-40°, 10° according to the drawing, is formed with the longitudinal axis 21*e*. Due to this quasi bent, buckled, or curved longitudinal curve, the strip 21*a* or the clamp 21 can adapt to the conical curve of a mouthpiece 2, when said strip is self-contained through bending, twisting around its own structural axis and upon insertion of the engagement element 21*c* into the slotted hole 21*b*. The twisting of the engagement element 21*c* around its structural axis is necessary due to the design with the aforementioned widening.

Figure 19:
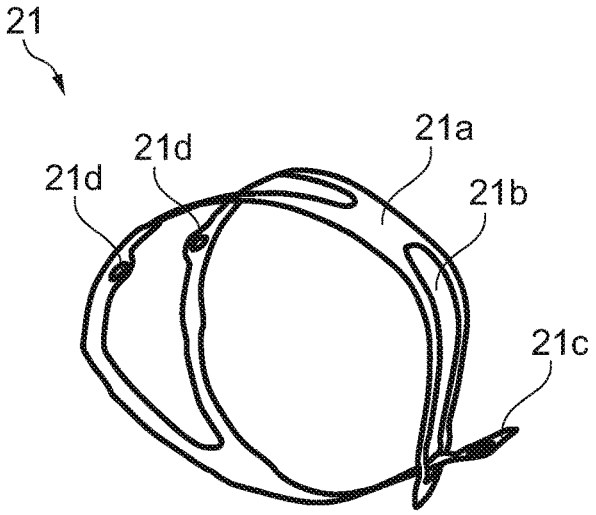
FIG. 19 shows a perspective representation of the strip of a clamp.

FIG. 19 shows the clamp 21, which is flatly placed in FIG. 18, with the strip 21*a* being bent and self-contained in a circular shape. A mouthpiece 2 with an approximately circular cross-section can be completely enclosed with this strip 21*a* or clamp 21, which is approximately bent into a circular shape. The engagement element 21*c* implemented with the widening is inserted into the slotted hole 21*b*. To disconnect this coupling, the strip 21*a* must twisted around its longitudinal axis in an elastically reversible manner in order to align the engagement element 21*c* or its widening parallel or at least with such an oblique angle with respect to the slotted hole longitudinal sides such that the engagement element 21*c*, with its widening, can be pushed through the slotted hole 21*b* unencumbered. Depending on the position of the engagement element 21*c* within the slotted hole 21*b* relative to its longitudinal extension, the clamp 21 can encompass mouthpieces 2 of different sizes. Because there are no adjusting devices or other means acting on the clamp 21 for the adjustment thereof according to FIG. 19, the engagement element 21*c* assumes a position on the outermost end of the slotted hole 21*b* due to the spring-hardened elastically reversible material properties and the resulting reset force, wherein the circumference is the maximum which can be encompassed by the strip 21*a*.

Figure 20:
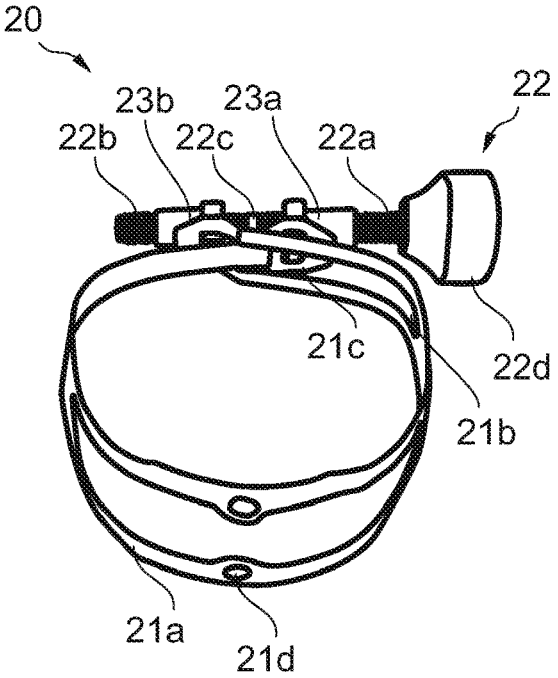
FIG. 20 shows a perspective representation of a fastening strap.

FIG. 20 shows a fastening strap 20, which has a clamp 21 in this case (cf. FIG. 19) and adaptation means for shifting and/or adjusting the engagement element 21*c* within the slotted hole 21*b* in order to encompass or surround or enclose mouthpieces 2 of different sizes. These means for adapting to differently sized mouthpieces 2 comprise, for example, an adjusting screw 22 and two nuts 23*a*, 23*b* engaging with the adjusting screw. One of the nuts 23*a*, 23*b* is connected to the first clamp end section 21*f* through welding, riveting, bonding, or another type of attachable or nondetachable joining process and preferably affixed to the available end, terminating at the slotted hole 21*b*, of the strip. The other respective nut 23*a*, 23*b* is connected to the second clamp end section 21*g* and preferably attached there to the widening strip 21*a* end formed on the engagement element 21*c*. The thread of the adjusting screw 22 is divided into two sequential sections in the longitudinal direction of the screw, a first thread section 22*a* and a second thread section 22*b*, wherein the directions of rotation of the two sections 22*a*, 22*b* rotate opposite one another, that is are oriented opposite one another. The direction of rotation of the first thread section 22*a* is formed, for example, as a right-hand thread, while the thread of the second thread section 22*b* is formed as a left-hand thread. The two thread sections 22*a*, 22*b* are separate from one another or distinct from one another, for example, by means of a radial thickening 22*c* of the shaft piece. The adjusting screw 22 can be operated or actuated via a handhold 22*d*.

Figure 21:
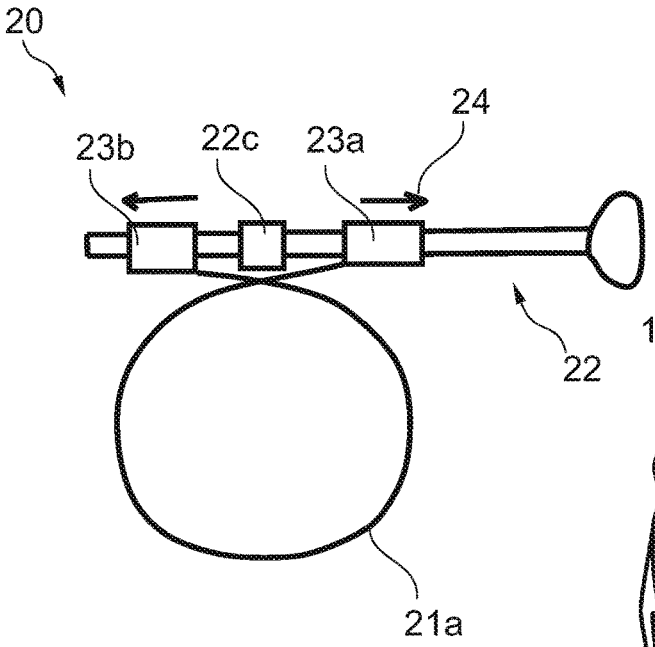
FIG. 21 shows a sectional representation of a fastening strap.

FIG. 21 illustrates, in a schematic view of the front of the fastening strap 20 and the adjusting screw 22 in its longitudinal extension, the operating principle with which the clamp 21 or the strip 21*a* can be adapted to the diameter of a mouthpiece 2. If the handhold 22*d* of the adjusting screw 22 is rotated clockwise, the two nuts 23*a*, 23*b*, which are engaged due to the opposite thread directions of the adjusting screw 22, obtain translational motions opposite one another such that the distance between the two nuts 23*a*, 23*b* enlarges. This goes hand in hand with an increasing clamping of the arrangement comprising the receiving block 4, bearing anchor 17*a*, and optionally other parts of the reed fixing device 15. The depicted arrows indicate this clamping process 24. Due to the enlargement of the distance between the two nuts 23*a*, 23*b*, the diameter which the strip 21*a* can encompass reduces. Thus, the clamping process 24 is initiated with which a reed 1 can be clamped to the mouthpiece 2 upon the mounting of a corresponding fixing device 15 (general 15, cf. FIG. 10 and/or receiving block 4, cf. FIG. 13) on the corresponding suspension means 21*d* (cf. FIGS. 19/20).

Figure 22:
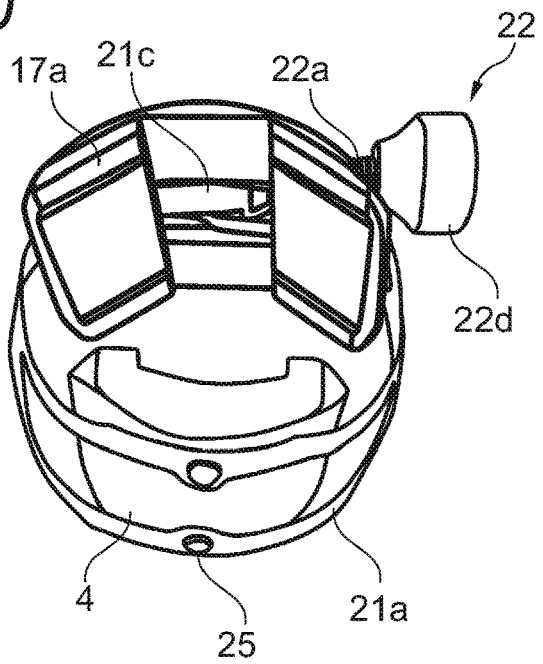
FIG. 22 shows a perspective representation of a fastening strap with bearing anchor and receiving block.

FIG. 22 shows such a fixing mechanism, designed as a receiving block 4 (cf. FIG. 3) according to the invention, which is mounted on the suspension means 21*d* (cf. FIGS. 19/20) of the strip 21*a* with fastening means 25 or screws. A bearing anchor 17*a* is located opposite the receiving block 4. Due to the closing mechanism set specifically via the adjusting screw 22 and the engagement element 21*c* located in the slotted hole 21*b*, a contact part 17*b* (cf. FIG. 15) can be dispensed with. If the adjusting screw 22 is activated at the handhold 22*d* to initiate the clamping process 24 (cf. FIG. 21), the engagement element 21*c* of the sheet metal strip 21*a* moves, within the slotted hole 21*b* (cf. FIG. 19), to that the slotted hole end, which is remote from the available end of the strip 21*a* or closest to its middle part 21*h*, according to the representation in FIG. 22. Especially preferably, this arrangement may be implemented from the fastening strap 20 and receiving block 4 as a preassembled arrangement 19 (cf. FIG. 14), in which the reed 1 is affixed in the receiving block 4 (FIGS. 6*a*, 6*b*) by means of spring bows 8, for example made of metal or plastic, before initiation of the clamping process 24 (cf. FIG. 21). The mounting process onto the mouthpiece 2 is thereby significantly facilitated, because the musician has both hands available for sliding the fastening strap 20 onto the mouthpiece 2 and then only has to align the front edge 1*a* of the reed 1 at the front edge 2*b* of the mouthpiece 2. For the purposes of producing material equivalency, both the receiving block 4 and the bearing anchor 17*a* are produced from the same material as the mouthpiece 2. Many mouthpieces 2 are produced from ebonite, a natural rubber. Thus, it is appropriate to produce all components of the ligature, which form a contact surface with the mouthpiece 2 when mounted on the mouthpiece 2, from ebonite. All foreign materials, such as brass or iron, can thus be kept away from the mouthpiece 2.

LIST OF REFERENCE NUMERALS

1 Reed
1*a* Front edge of the reed
1*b* Vibration area of the reed
1*c* Clamping area of the reed
1*d* Side surfaces of the reed
1*e* Bottom of the reed
1*f* Axis of symmetry or longitudinal axis of the reed
2 Mouthpiece
2*a* Connection to the body of the instrument
2*b* Front edge of the mouthpiece
2*c* Longitudinal axis of the mouthpiece
2*d* Bearing surface of the mouthpiece
3 Conventional ligature
3*a* Retaining sheet of the ligature
3*b* Adjusting screws of the ligature
4 Receiving block
4*a* Inner bearing surface of the receiving block
4*b* Limiting walls
4*c* Inner side surfaces of the limiting walls
4*d* Outer side of the receiving block
4*e* Front edge of the receiving block
4*f* Insertion aid
4*g* Locking holes
5 Clamping device
5*a* Tensioning strap/tensioning belt
5*b* Adjusting screw
5*c* Thread of the adjusting screw
5*d* Guide of the adjusting screw
5*e* Receiving holes for locking pins
6 Meander spring for receiving block
6*a* Grooves/notches on the outer side of the receiving block
6*b* Grooves/notches on the inner side of the receiving block
7 Preassembled arrangement with receiving block
8 Spring bow/elastic springs
8*a* 4-point support point between spring bow and reed
8*b* Support point between spring bow and receiving block
9 Locking pins/locking screws
10 Arrangement of the receiving block in the clamping device
12 Spacer
12*a* Contact area between the spacer and mouthpiece
14 Forces of the ligature onto the reed
15 General fixing device for reed/pressure plate
16 Connector/anchor
16*a* Flat connection to the upper part
16*b* Fastening means
17 Upper part
17*a* Bearing anchor
17*b* Contact part
18 Adjusting means/knurled screw with thread
19 Preassembled arrangement with receiving block and spacer device
20 Fastening strap
21 Clamp/bow
21*a* Strip
21*b* Slotted hole
21*c* Engagement element
21*d* Suspension means for reed fixing device or receiving block
21*e* Longitudinal axis of the clamp
21*f* First end section of the clamp or clamping sheet
21*g* Second end section of the clamp or clamping sheet
21*h* Middle part of the clamp or clamping sheet
22 Adjusting screw
22*a* First thread section
22*b* Second thread section
22*c* Radial thickening
22*d* Handhold
23*a* Nut of the first thread section
23*b* Nut of the second thread section
24 Clamping process
25 Fastening means

The invention claimed is:

1. A ligature for woodwind instruments having a receiving block (4), which clamps a reed (1) to a mouthpiece (2) of the woodwind instrument, while preventing twisting or sliding, by exerting a compressive force (14) on the reed (1), so that an axis of symmetry or longitudinal direction (1*f*) of the reed (1*f*) is aligned with an axis of symmetry or longitudinal direction of a bearing surface of the mouthpiece (2), characterized in that the receiving block (4) receives the reed (1) in a force-fitting manner or establishes a form-fit with at least one side surface (1*d*) of the reed (1) wherein the ligature formed for use as a preassembled arrangement (7, 19), which is mountable on the mouthpiece (2), having a reed (1) and a receiving block (4) holding said reed, wherein the reed (1) can be coupled to the receiving block (4) or ligature either in a force-fitting or in both a form-fitting and a force-fitting manner, before the clamping of the receiving block (4) or the ligature on the mouthpiece (2) in its predetermined relative position with respect to the ligature.

2. A receiving block (4) for a ligature for woodwind musical instruments, in order to clamp a reed (1) to a mouthpiece (2) of the woodwind instrument, while preventing twisting or sliding, by exerting a compressive force (14) onto the reed (1), so that an axis of symmetry or longitudinal direction of the reed (1*f*) is aligned with an axis of symmetry or longitudinal direction of a bearing surface of the mouthpiece (2), characterized in that the receiving block (4) has a mechanism (6, 8) for tho a force-fitting coupling with the reed (1) or for forming a form-fit with at least one side surface (1d) of the reed (1), wherein the receiving block is formed for use as a preassembled arrangement (7, 19), which is mountable on the mouthpiece (2), having a reed (1) and a receiving block (4) holding said reed, wherein the reed (1) can be coupled to the receiving block (4) or ligature either in a force-fitting or in both a form-fitting and a force-fitting manner, before clamping of the receiving block (4) or the ligature on the mouthpiece (2) in its predetermined relative position with respect to the ligature.

3. The receiving block (4) according to claim 2, characterized in that the receiving block (4) has at least one bow (8), formed with springy elastic material, which is formed for exerting a force-fit with a side surface (1*d*) of an insertable or inserted reed (1).

4. The receiving block (4) according to claim 2, characterized in that the receiving block (4) has a mechanism (7) for tolerance adaptation for tho a purpose of compensating for reed dimensional tolerances, wherein the mechanism (7) for tolerance adaptation comprises at least two elastic spring bows or springy elastic bows (8) in limiting walls (4*b*) of the receiving block, which are laterally incorporated into the limiting walls (4*b*) of the receiving block (4), wherein each spring bow (8) is suitable for forming a force-fit with the two side surfaces (1*d*) of an insertable or inserted reed (1).

5. The receiving block (4) according to claim 2, characterized in that the receiving block (4) consists of the same material as the mouthpiece (2) of the woodwind instrument or as a resonance chamber of the musical instrument.

6. A ligature for holding a reed in woodwind musical instruments, characterized by a spacer device with at least one spacer (12), which is formed with a contact area (12*a*) allocated to a mouthpiece (2) and is arranged for purposes of preventing other components of the ligature from coming into direct contact with the mouthpiece (2) wherein the spacer or spacers (12) or the spacer device is made of the same material as the mouthpiece (2) of the woodwind instrument or as a resonance chamber of the musical instrument, wherein the spacer or spacers (12) are each formed as at least one edge or as a protrusion of a pressure block or other upper part (17).

7. A fastening strap (20) for clamping a reed (1) to mouthpieces (2) of woodwind instruments, wherein the fastening strap (20) is formed with reversibly deformable or elastic material and has a clamp (21), which is formed as an elastic strip (21*a*), sheet metal strip, or wire piece, in order to bend around the mouthpiece (2), wherein the strip (21*a*) has a first end section (21*f*), a middle section (21*h*), and a second end section (21*g*) and the strip (21*a*) is bendable or bent in order to surround or encompass a mouthpiece (2), characterized in that the at least two end sections (21*f*, 21*g*) have at least one mechanism (21*b*, 21*c*) each for direct coupling to one another, wherein at least one mechanism for coupling to the first end section (21*f*) of the strip (21*a*) has a slotted hole (21*b*) or a groove or a track or a recess or a notch, in that the at least one mechanism for coupling to the second end section (21*g*) of the strip (21*a*) has an engagement element (21*c*) or a complementary counter-notch, each of which is formed complementarily for coupling with the slotted hole (21*b*) or the groove or the track or the recess or the notch and by an adjusting screw (22) or other manually operable adjusting element for sliding or adjusting the engagement element (21*c*) along a guide, which is formed by the slotted hole (21*b*) or groove or track, or recess, for a clamping process (24) or a clamping movement of the fastening strap (20) on or opposite an intended instrument mouthpiece (2).

8. The fastening strap (20) according to claim 7, characterized in that the first (21*f*) or the second (21*g*) end section is formed as elongated legs, which are aligned at an angle of 10° or between 5-40° , against a longitudinal axis (21*e*) of the strip or its middle part, in a flatly rolled out or placed state of the strip.

9. The fastening strap (20) according to claim 7, characterized in that the adjusting screw (22) comprises a thread, which has a first thread section (22*a*) and a second thread section (22*b*), wherein the first (22*a*) and the second thread section (22*b*) have opposite directions of rotation with respect to one another, and the clamp (21) has an attached nut (23*a*, 23*b*) on its first and on its second end section (21*f*, 21*g*), wherein the nuts of the first end section (21*f*) are intermeshed with the second thread section (22*b*) of the adjusting screw (22) or the nuts of the second end section (21*g*) are intermeshed with the first thread section (22*a*) of the adjusting screw (22).

10. The fastening strap (20) according to claim 7, characterized in that the clamping process (24) for clamping a reed (1) to the mouthpiece (2) can be implemented with actuation of the adjusting screw (22), wherein a distance between the two nuts (23*a*, 23*b*) enlarges with respect to each other.

11. The fastening strap (20) according to claim 7, characterized by an upper part (17) or a bearing anchor (17*a*), which are arranged such that they are pressable or can be pressed against a surface of the mouthpiece (2) during the clamping process (24).

* * * * *